US006826793B2

(12) United States Patent
Tekulve

(10) Patent No.: US 6,826,793 B2
(45) Date of Patent: Dec. 7, 2004

(54) ARTICULATING BED FRAME

(76) Inventor: Daniel R. Tekulve, 2056 Shrine Rd., Batesville, IN (US) 47006

( * ) Notice: Subject to any disclaimer, the term of this patent is extended or adjusted under 35 U.S.C. 154(b) by 5 days.

(21) Appl. No.: 10/359,087

(22) Filed: Feb. 5, 2003

(65) Prior Publication Data

US 2004/0148704 A1 Aug. 5, 2004

(51) Int. Cl.[7] ..... A61G 7/015; A61G 7/018
(52) U.S. Cl. ..... 5/618; 5/616; 5/81.1 R
(58) Field of Search ..... 5/618, 613, 616, 5/617, 81.1 R, 86.1

(56) References Cited

U.S. PATENT DOCUMENTS

| | | | | |
|---|---|---|---|---|
| 1,658,780 A | | 2/1928 | Nixon | |
| 2,026,153 A | | 12/1935 | Wright et al. | |
| 2,189,325 A | | 2/1940 | Rich | |
| 2,349,701 A | | 5/1944 | Buttikofer et al. | |
| 2,651,785 A | | 9/1953 | Berner | |
| 3,051,965 A | | 9/1962 | Szemplak et al. | |
| 3,105,247 A | | 10/1963 | Katz | |
| 3,191,195 A | | 6/1965 | Schlackman et al. | |
| 3,261,639 A | | 7/1966 | Phillips | |
| 3,267,493 A | | 8/1966 | Pruim et al. | |
| 3,447,170 A | | 6/1969 | Spitz | |
| 3,593,350 A | * | 7/1971 | Knight et al. | 5/616 |
| 3,821,821 A | * | 7/1974 | Burst et al. | 5/616 |
| 3,887,951 A | | 6/1975 | Yates et al. | |
| 3,958,283 A | * | 5/1976 | Adams et al. | 5/616 |
| 3,972,081 A | | 8/1976 | Stern et al. | |
| 4,025,972 A | * | 5/1977 | Adams et al. | 5/616 |
| 4,095,296 A | | 6/1978 | Ferro | |
| 4,097,939 A | * | 7/1978 | Peck et al. | 5/611 |
| 4,097,940 A | * | 7/1978 | Tekulve et al. | 5/616 |
| 4,258,445 A | * | 3/1981 | Zur | 5/614 |
| 4,344,422 A | | 8/1982 | Immel | |
| 4,349,924 A | | 9/1982 | Zur | |
| 4,395,786 A | | 8/1983 | Casey et al. | |
| 4,559,656 A | | 12/1985 | Foster | |
| 4,592,104 A | | 6/1986 | Foster et al. | |
| 4,821,351 A | | 4/1989 | Bergenwall | |
| 5,063,623 A | | 11/1991 | Bathrick et al. | |
| 5,095,562 A | | 3/1992 | Alexander | |
| 5,105,486 A | | 4/1992 | Peterson | |
| 5,161,274 A | | 11/1992 | Hayes et al. | |
| 5,165,129 A | | 11/1992 | Rohm | |
| 5,205,004 A | | 4/1993 | Hayes et al. | |
| 5,245,718 A | | 9/1993 | Krauska | |

(List continued on next page.)

*Primary Examiner*—Robert G. Santos
(74) *Attorney, Agent, or Firm*—Woodard, Emhardt, Moriarty, McNett & Henry LLP

(57) ABSTRACT

An articulating bed frame includes a main frame; a back section connected to the main frame by first and second linkage assemblies, each of the first and second linkage assemblies being pivotally connected at first and third ends to the back section and pivotally connected at opposing respective second and fourth ends to the main frame; an upper leg section connected to the main frame by a third linkage assembly and a support link assembly, the third linkage assembly being pivotally connected at opposing fifth and sixth ends to the upper leg section and the main frame, respectively, and the support link assembly being rigidly connected at a seventh end to the upper leg section and being slidably and pivotably connected at an opposing eighth end to the main frame; a seat section pivotally connected at opposing ends to the back section and the upper leg section; a lower leg section pivotally connected to the upper leg section and freely supported atop a forward end of the main frame; and, a drive assembly connected at first and second connection ends to and between the back section and the third linkage assembly, the drive assembly being operable to extend and retract to move the first and second connection ends away and toward each other.

36 Claims, 10 Drawing Sheets

U.S. PATENT DOCUMENTS 5,329,657 A * 7/1994 Bartley et al. ..... 5/617
5,392,479 A 2/1995 Liao
5,479,665 A 1/1996 Cassidy et al.
RE35,201 E 4/1996 Krauska
5,515,561 A 5/1996 Suggitt et al.
5,535,464 A 7/1996 Salonica
5,537,701 A * 7/1996 Elliott ..... 5/617
5,568,661 A 10/1996 Bathrick et al.
5,577,279 A 11/1996 Foster et al.
5,640,730 A 6/1997 Godette
5,708,997 A * 1/1998 Foster et al. ..... 5/618
5,870,784 A * 2/1999 Elliott ..... 5/618
5,933,888 A 8/1999 Foster et al.
6,006,379 A 12/1999 Hensley
6,112,345 A * 9/2000 Foster et al. ..... 5/81.1 R
6,161,236 A 12/2000 Carroll
6,163,904 A 12/2000 Royston
6,209,157 B1 4/2001 Hensley
6,230,344 B1 5/2001 Thompson et al.
6,230,346 B1 5/2001 Branson et al.
6,276,011 B1 8/2001 Antinori
6,351,861 B1 3/2002 Shows et al.
6,357,065 B1 3/2002 Adams
6,360,386 B1 3/2002 Chuang
6,374,436 B1 * 4/2002 Foster et al. ..... 5/81.1 R
6,516,480 B2 * 2/2003 Elliott ..... 5/618
6,694,548 B2 * 2/2004 Foster et al. ..... 5/600
6,725,474 B2 * 4/2004 Foster et al. ..... 5/81.1 R
2002/0078505 A1 * 6/2002 Brooke et al. ..... 5/618
2002/0116760 A1 * 8/2002 Foster et al. ..... 5/81.1 R
2003/0019036 A1 * 1/2003 Foster et al. ..... 5/430

* cited by examiner

ARTICULATING BED FRAME

FIELD OF THE INVENTION

The present invention relates to bed frames, and more particularly to an articulating bed frame for home, nursing home and hospital healthcare.

BACKGROUND OF THE INVENTION

Beds and bed frames constructed for home, nursing and hospital healthcare environments provide for articulation of the frame to tilt one or more sections for the patient's comfort and/or care. With the push of a button or lever, the back section can be made to tilt between a completely flat, reclined position and a forward, inclined position, or one or more leg positions may be made to bend or tilt between a generally flat and horizontal position and a drawn-up, bent position. More particularly, since most beds are positioned against a wall, some beds have back sections that hug the wall when inclined (raised), which provides additional space at the foot end. This also allows patients to stay within reach of bed side cabinets. To accomplish this, the existing designs of such bed frames typically comprise multiple sliding frames that retract with pivoting linkages that are heavy and costly to manufacture. In addition, the movement of such members may define a path that is larger than the underlying mattress footprint, which thus takes up more space unnecessarily.

What is desired is a bed frame that is lighter, cheaper to manufacture, has a smaller operating footprint, and still hugs the wall when inclined.

SUMMARY OF THE INVENTION

The present invention provides a bed frame that may be articulated between a generally flat and horizontal position and a back-inclined position, all while maintaining a substantially wall-hugging configuration at the head of the bed frame.

Generally speaking, an articulating bed frame includes a main frame; a back section connected to the main frame by first and second linkage assemblies, that are each pivotally connected at first and third ends to the back section and pivotally connected at opposing respective second and fourth ends to the main frame; an upper leg section connected to the main frame by a third linkage assembly and a support link assembly, the third linkage assembly being pivotally connected at opposing fifth and sixth ends to the upper leg section and the main frame, respectively, and the support link assembly being rigidly connected at a seventh end to the upper leg section and being slidably and pivotably connected at an opposing eighth end to the main frame; a seat section pivotally connected at opposing ends to the back section and the upper leg section; a lower leg section pivotally connected to the upper leg section and freely supported atop a forward end of the main frame; and, a generally linear drive assembly connected at first and second connection ends to and between the back section and either the third linkage assembly or the main frame, the drive assembly being operable to extend and retract to move the first and second connection ends away and toward each other, thereby articulating the bed frame between the fully reclined and fully inclined positions.

The bed frame also allows for a much smaller mattress footprint and permits itself to be folded to a compact, more easily manipulated condition for transport or storage.

It is an object of the present invention to provide an improved bed for hospital, home and nursing care applications.

It is another object of the present invention to provide a space saving and wall hugging bed/bed frame for hospital, home and nursing care applications.

Further objects and advantages will become apparent from the following description of the preferred embodiment.

DETAILED DESCRIPTION OF THE PREFERRED EMBODIMENT

Figure 1:
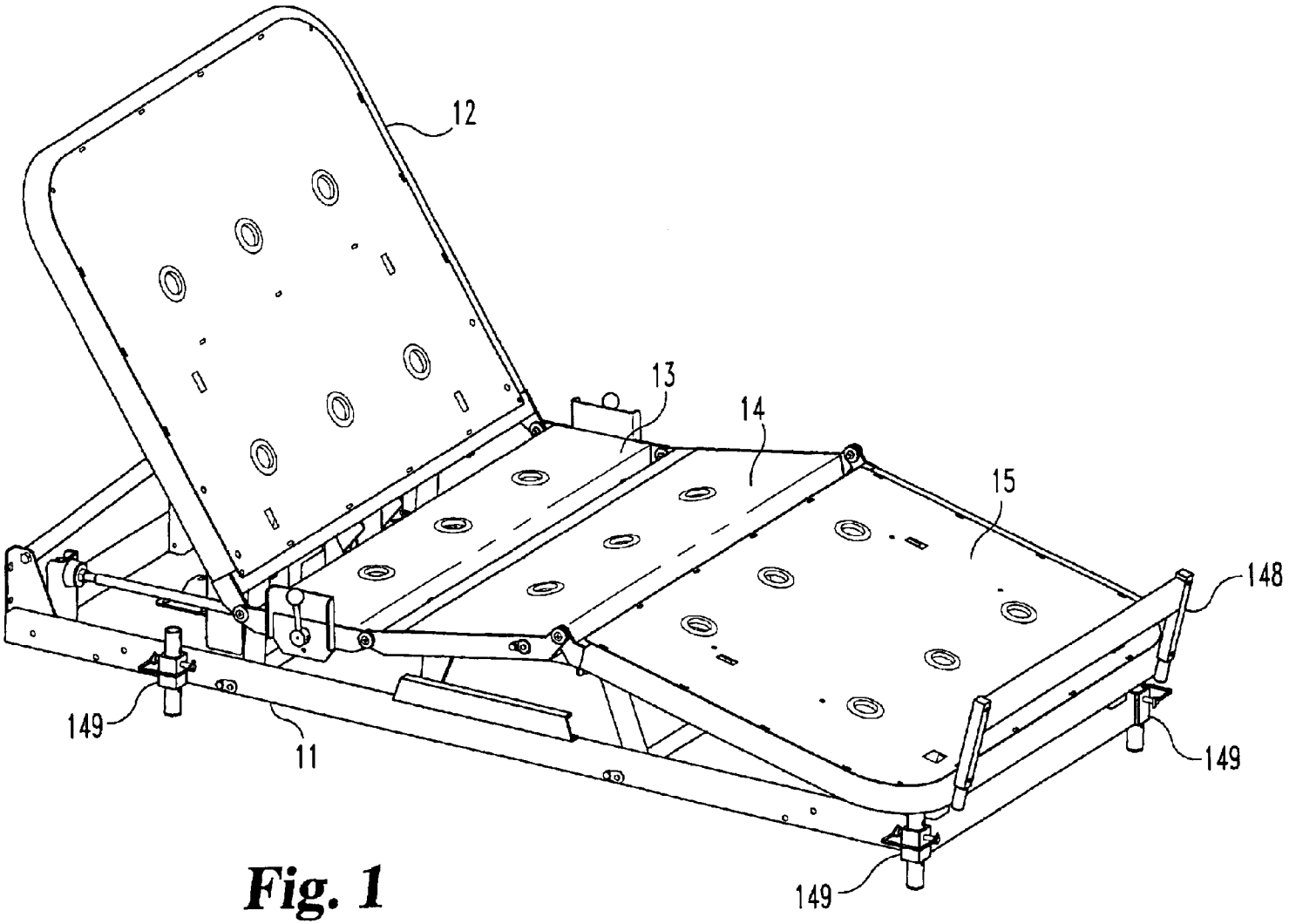
FIG. 1 is a top, perspective view of an articulating bed frame 10 in accordance the present invention and shown in the fully inclined position.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations or modifications in the illustrated device, and any further applications of the principles of the invention as illustrated therein are contemplated as would normally occur to one skilled in the art to which the invention relates.

Figure 5:
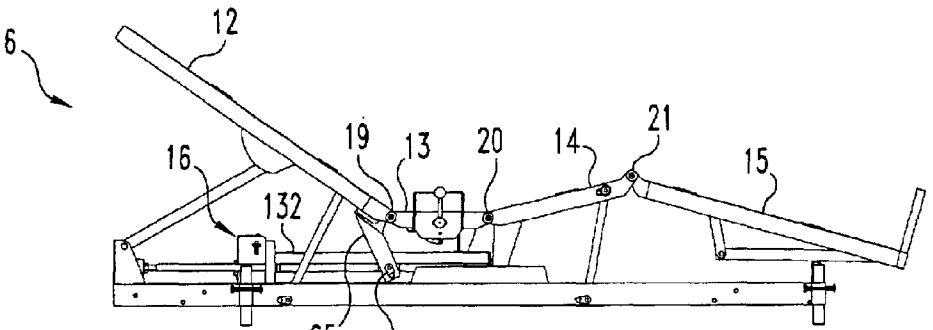
FIG. 5 is a side view of the articulating bed frame 10 of FIG. 4.
Figure 6:
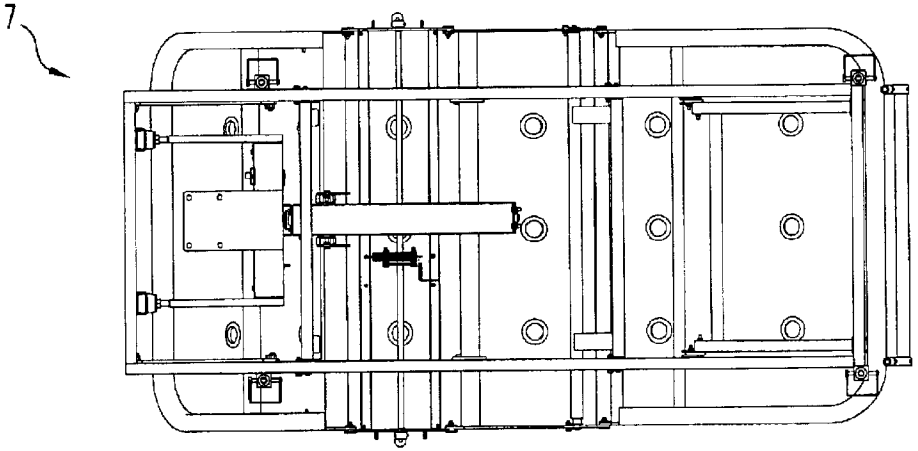
FIG. 6 is a bottom view of the articulating bed frame 10 of FIG. 1 and shown in the fully inclined position 7.

Referring to FIGS. 1–7, there is shown an articulating bed frame 10 in accordance with the present invention. Bed frame 10 can be articulated between a fully reclined position 5 shown in FIGS. 2 and 3 and a fully inclined position 7 shown in FIGS. 7 and 8, as well as all positions in between, such as intermediate position 6 shown in FIG. 5. Bed frame 10 generally includes a main frame 11, a back section 12, a seat section 13, an upper leg section 14, a lower leg section 15 and an articulation drive assembly indicated generally at 16 (FIG. 5). Sections 12–15 are pivotally interconnected along parallel, horizontal axes 19, 20 and 21, as shown.

Figure 3:
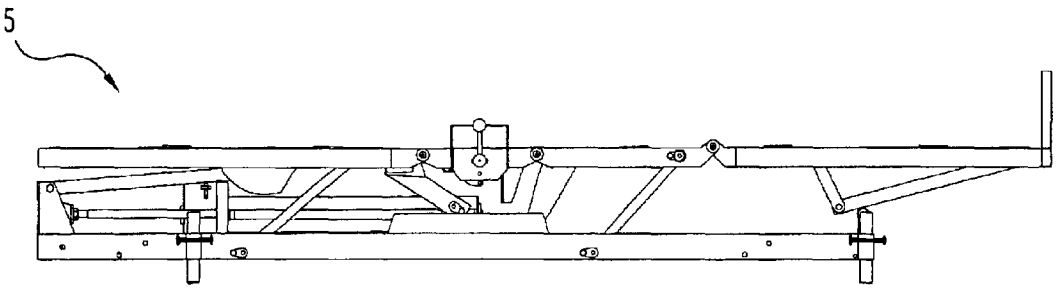
FIG. 3 is a side view of the articulating bed frame 10 of FIG. 2.
Figure 4:
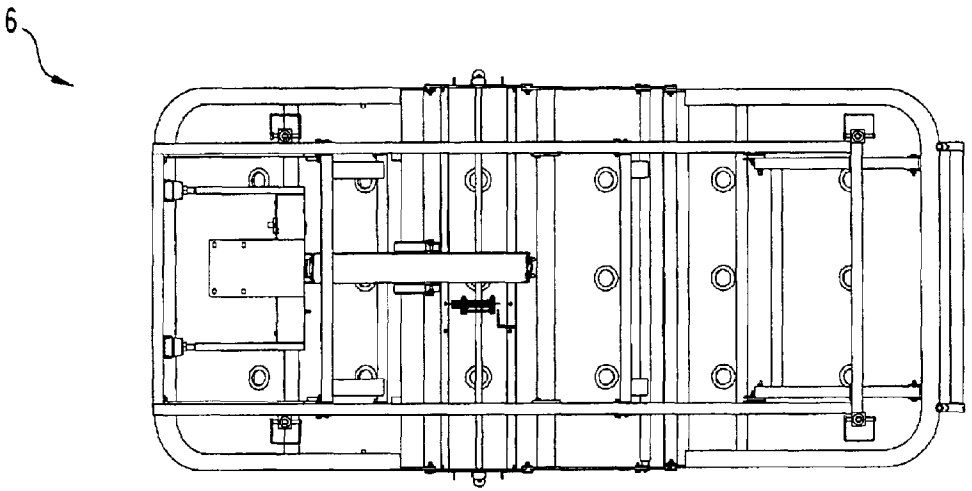
FIG. 4 is a bottom view of the articulating bed frame 10 of FIG. 1 and shown in a partially inclined position 6.
Figure 7:
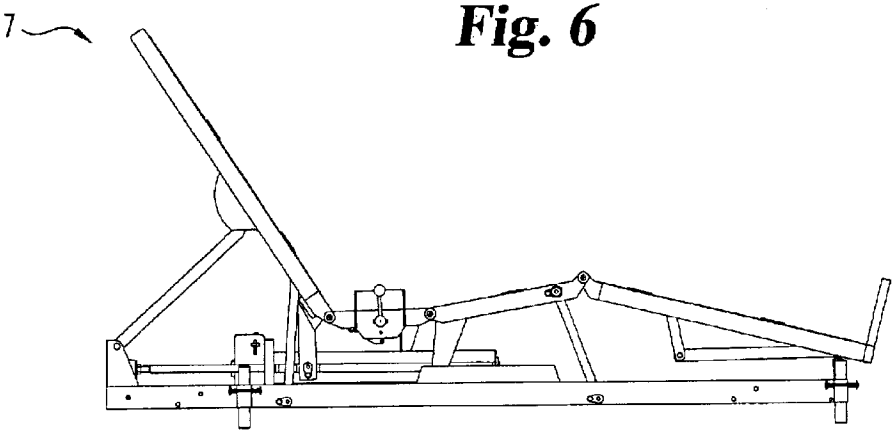
FIG. 7 is a side view of the articulating bed frame 10 of FIG. 6.
Figure 8:
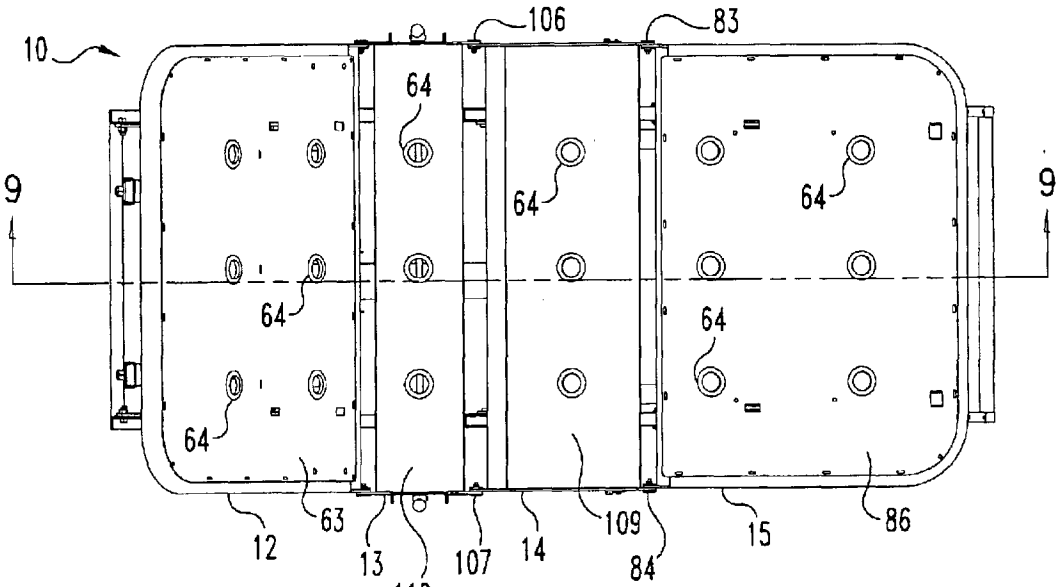
FIG. 8 is a top view of the articulating bed frame 10 of FIG. 6.

The fully reclined position, as used herein, refers to the condition where all the bed sections members (back 12, seat 13, upper leg 14 and lower leg 15) are juxtaposed in a generally horizontal and co-planar position, as shown in FIG. 3. The fully inclined position, as used herein, refers to the condition where the same bed sections, through their pivotal interconnections, are tilted relative to each other as far from the fully reclined position as their linkages will allow, thereby inclining the back section 12 and drawing in the leg sections 14 and 15, as shown in FIG. 7, to form a slightly inverted "V" shape. Thus, the fully reclined and fully inclined positions represent the extremes of articulation of bed frame 10. Alternative embodiments contemplate that the bed section 12–15 may be in different positions for these extremes than are shown herein. For example, in one embodiment, the fully reclined position may have bed section 12 pivoted beyond horizontal so that the patient's head is lowered below the rest of his body.

Figure 9:
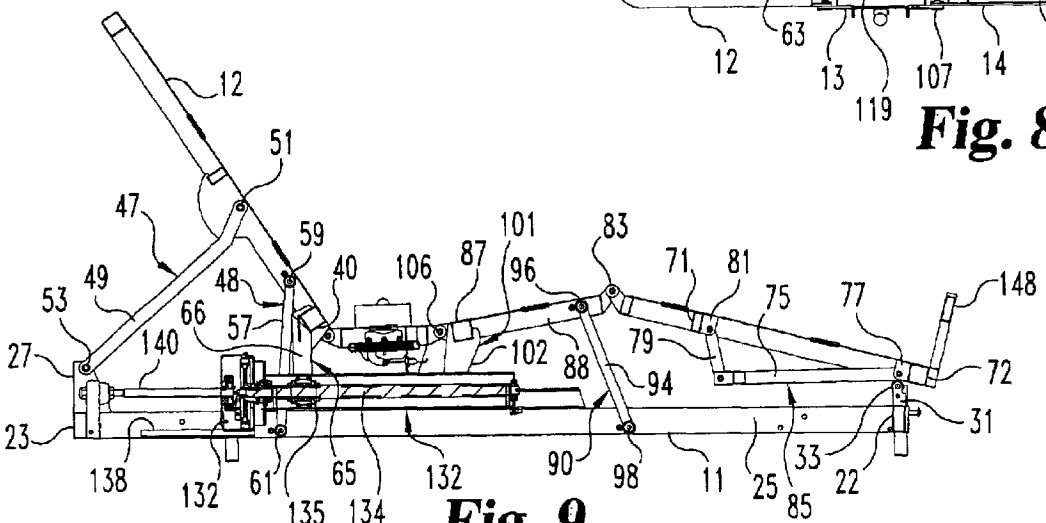
FIG. 9 is a side, cross-sectional view of the articulating bed frame 10 of FIG. 8 taken along the lines 9—9 and viewed in the direction of the arrows.
Figure 10:
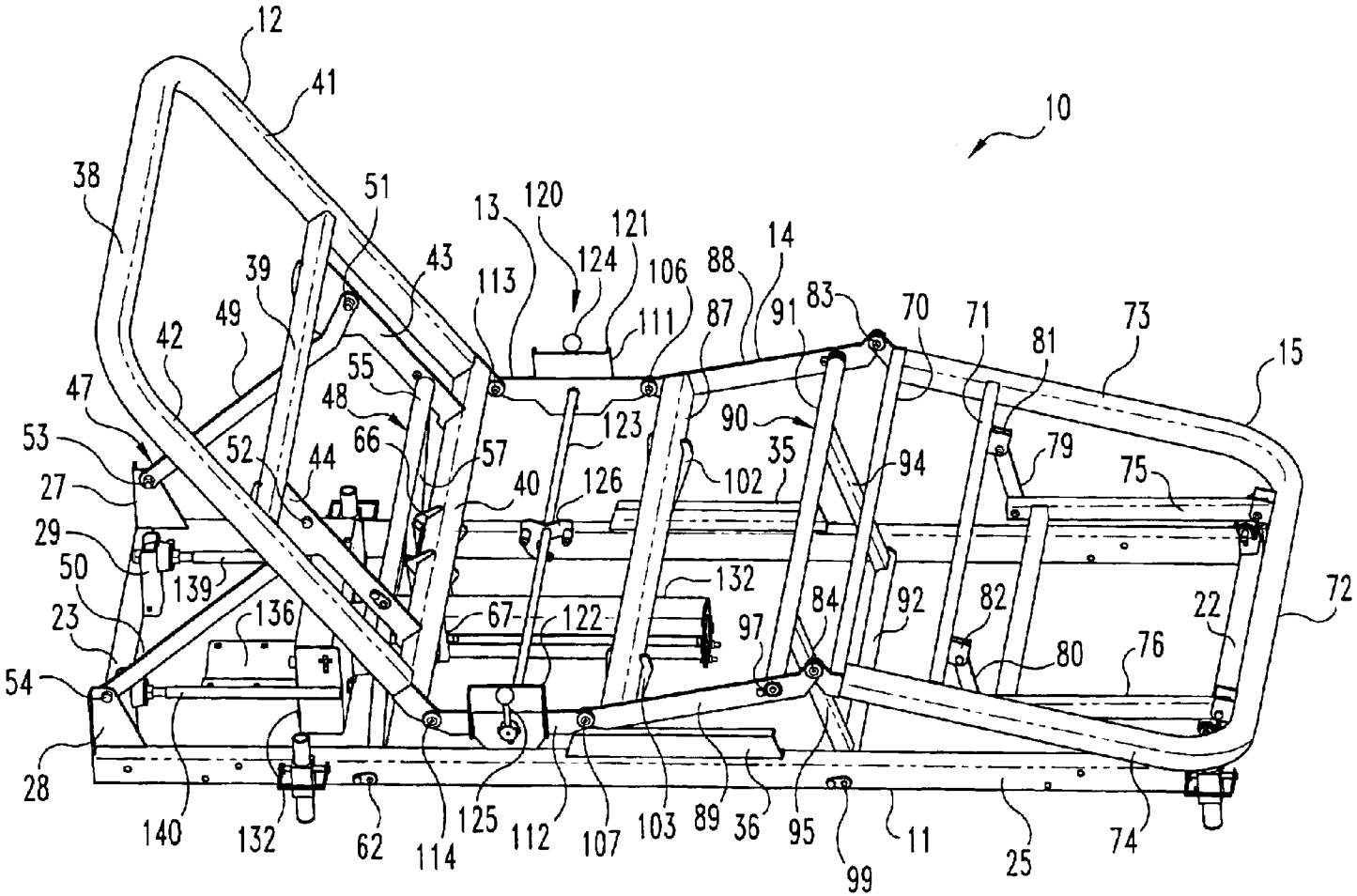
FIG. 10 is a top, perspective view of the articulating bed frame 10 of FIG. 1 with several components removed for viewing clarity.
Figure 11:
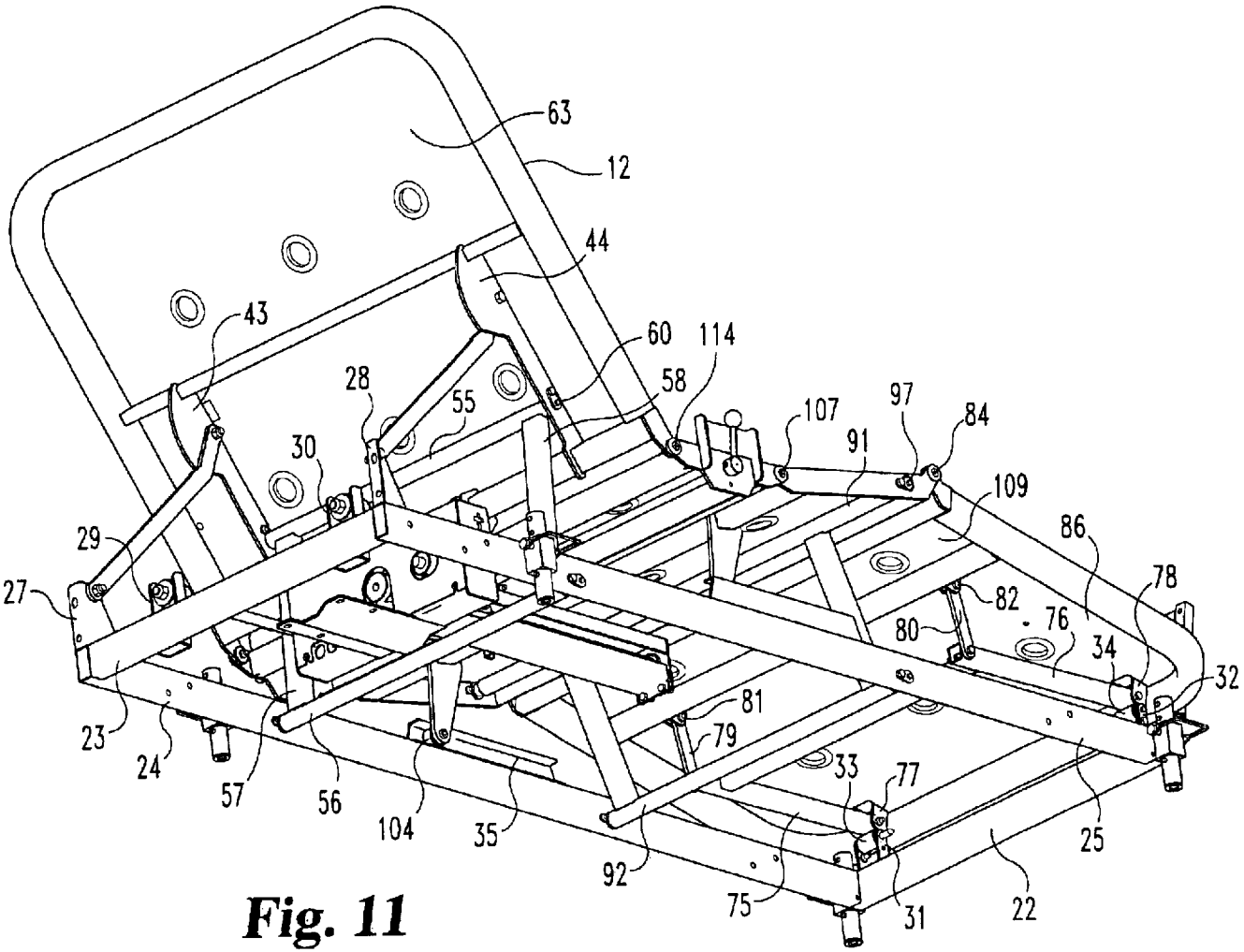
FIG. 11 is a bottom, perspective view of the articulating bed frame 10 of FIG. 1.

Referring to FIGS. 9–11, main frame 11 is a generally rectangular frame of tubular metal construction having opposing front and rear rails 22 and 23, opposing side rails 24 and 25, a pair of rear, upstanding linkage brackets 27 and 28, a pair of rear, drive mounting brackets 29 and 30, and a pair of front, roller mounting brackets 31 and 32. Roller mounting brackets 31 and 32 rotatably hold rollers 33 and 34. A pair of opposing, C-shaped roller channels 35 and 36 are mounted atop side rails 24 and 25, respectively, about midway between front and rear rails 22 and 23.

Back section 12 is a generally rectangular frame of tubular metal construction and includes upper, middle and lower crossbars 38, 39 and 40 extending between opposing side arms 41 and 42, respectively. A pair of pivot head braces 43 and 44 extend rigidly between middle and lower crossbars 39 and 40, and braces 43 and 44 are spaced inwardly from side arms 41 and 42, respectively. First and second linkage assemblies 47 and 48 connect back section 12 with main frame 11. First linkage assembly 47 includes a pair of linkages 49 and 50, which are pivotally connected at their upper ends at pins 51 and 52, respectively, to an upper region of braces 43 and 44, as shown. Linkages 49 and 50 are pivotally connected at their opposing, lower ends to linkage brackets 27 and 28 by pins 53 and 54, respectively. Second linkage assembly 48 includes upper and lower pivot tubes 55 and 56 that are rigidly connected to each other by a pair of opposing connector tubes 57 and 58. Upper pivot tube 55 is pivotally connected to, between and at the lower portions of braces 43 and 44 by appropriate means such as pins 59 and 60. Lower pivot tube 56 is pivotally connected to and between the side rails 24 and 25 of main frame II by appropriate means such as pins 61 and 62. Main frame 11, back section 12 and linkage assemblies 47 and 48 thus form a closed quadrilateral linkage assembly that is limited to articulate between the fully reclined position 5 of FIG. 3 and the fully inclined position 7 shown in FIG. 7.

A back section cover plate 63 is fixedly secured to and atop crossbars 38, 39 and 40 and side arms 41 and 42, cover plate 63 providing additional structural support for back section 12. A plurality of holes with grommets 64 are provided in cover plate 63 for ventilation.

Figure 2:
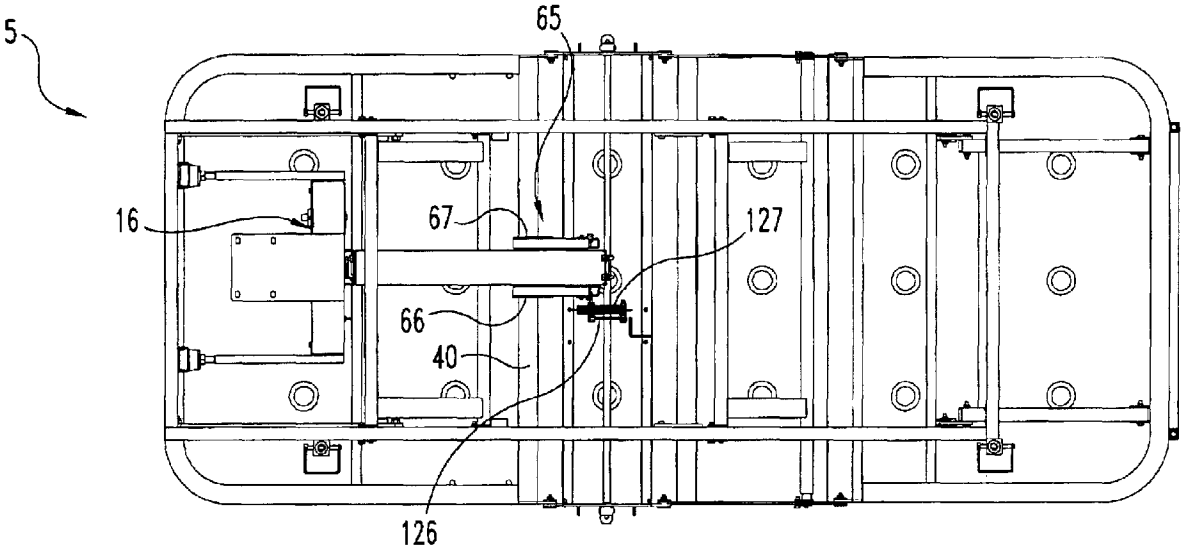
FIG. 2 is a bottom view of the articulating bed frame 10 of FIG. 1 and shown in the fully reclined position 5.

Also connected with back section 12 is a first drive linkage assembly 65 (FIGS. 2 and 9). Assembly 65 includes a pair of drive links 66 and 67 that are rigidly mounted to lower crossbar 40 of back section 12 and extend downwardly therefrom for connection with the drive assembly 16 as will be described herein.

Like back section 12, lower leg section 15 is a generally rectangular frame of tubular metal construction and includes upper, middle and lower crossbars 70, 71 and 72 extending between opposing side rails 73 and 74, respectively. A pair of roller bars 75 and 76 are connected at their forward ends to connector brackets 77 and 78, which are fixedly connected to lower crossbar 72. At their rearward ends, roller bars 75 and 76 are connected to the lower ends of hanger links 79 and 80. Links 79 and 80 are connected at their upper ends to connector brackets 81 and 82, which are connected to middle crossbar 71. Forwardly, lower leg section 14, and more particularly, roller bars 75 and 76, ride upon rollers 33 and 34. Roller bars 75 and 76, hanger links 79 and 80 and rollers 33 and 34 together form a track and guide assembly 85. Alternative embodiments are contemplated wherein track and guide assembly 85 includes low friction slides instead of rollers 33 and 34 to permit roller bars 75 and 76 to slide thereon. Alternatively, rollers or sliding elements are contemplated to be mounted to lower leg section 15 with track members mounted to or made as a part of main frame 11. Other embodiments contemplate any suitable complementary track and guide arrangement to permit lower leg section 15 to ride along the forward end of main frame 11 either freely (as shown in herein) or with some releasable restriction to permit lower leg section to be easily folded over at axis 21 for transport, as described herein. Rearwardly, lower leg section 15 is pivotally connected to upper leg section 14 by pins 83 and 84. As with cover plate 63, a lower section cover plate 86 with holes and grommets 64 is fixedly secured to crossbars 71 and 72 and side rails 73 and 74.

Upper leg section 14 comprises a rear crossbar 87 extending between opposing side rails 88 and 89, respectively. A third linkage assembly 90 connects the front end of upper leg section 14 to main frame 11 and includes upper and lower pivot tubes 91 an 92 that are rigidly connected to each other by a pair of opposing connector tubes 94 and 95. Upper pivot tube 91 is pivotally connected to and between side rails 88 and 89 by pins 96 and 97, respectively. Lower pivot tube 92 is pivotally connected to and between main frame side rails 24 and 25 by pins 98 and 99, respectively. A support link assembly 101 includes a pair of opposing support links 102 and 103 that are rigidly connected to and extend downwardly from rear crossbar 87. At the bottom of each support link 102 and 103 is rotatably connected a roller (one shown at 104), each roller being received to ride within a corresponding one of roller channels 35 and 36. In the present embodiment, roller channels 35 and 36 are straight, which produces substantially straight movement for the lower ends of links 102 and 103. Alternative embodiments are contemplated wherein roller channels 35 and 36 are at least partially non-linear to produce an alternative path for the seat and upper leg sections 13 and 14, as desired. Rearwardly, upper leg section 14 is pivotally connected to seat section 13 by pins 106 and 107, respectively. An upper leg section cover plate 109 has a generally C-shaped cross-section and is fixedly secured to crossbar 87 and side rails 89 and 90 by appropriate means such as welding.

Figure 12:
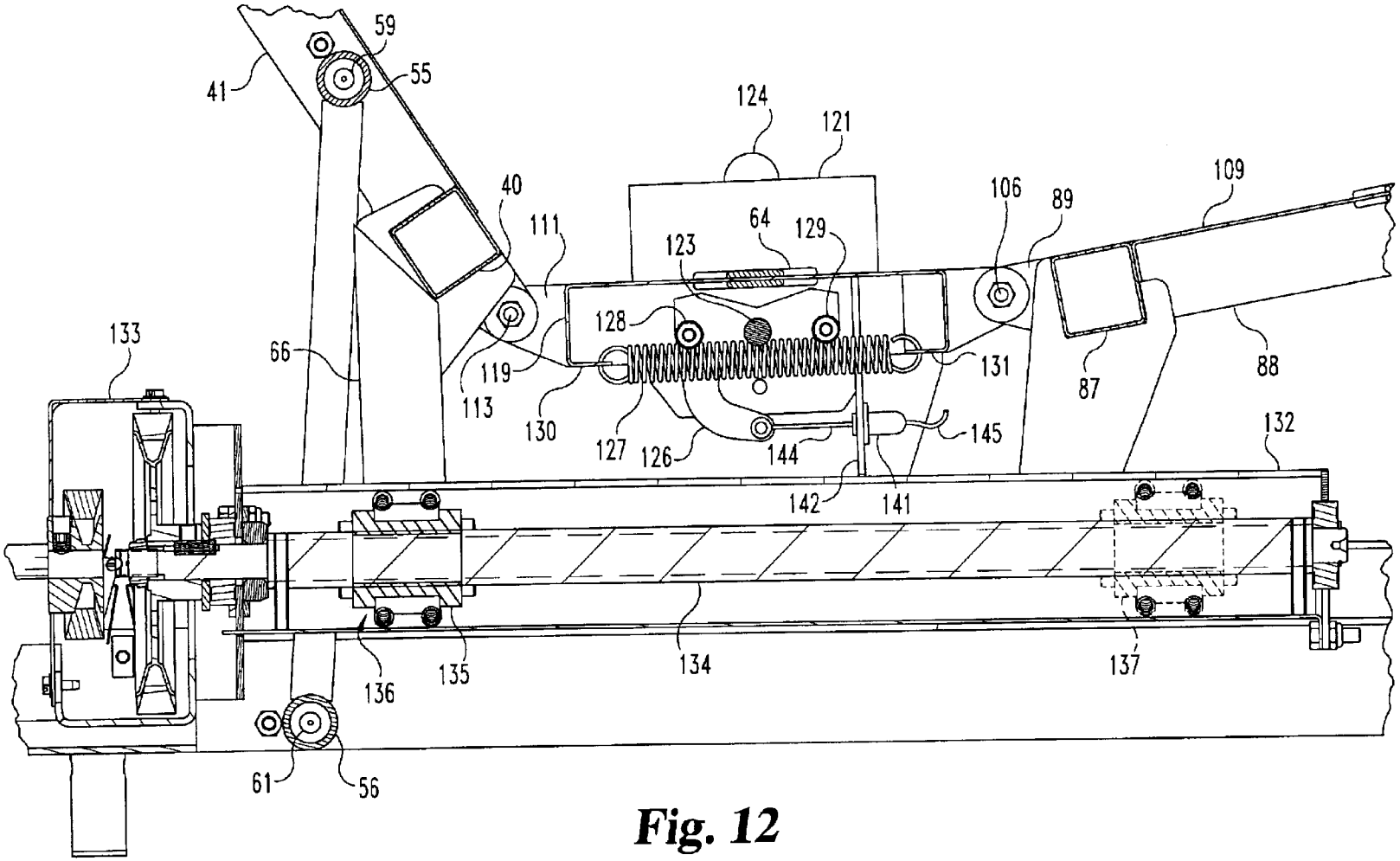
FIG. 12 is an enlarged, side view of the central portion of articulating bed frame 10 of FIG. 9.

Referring to FIGS. 9, 10 and 12, seat section 13 generally comprises opposing side rails 111 and 112 that are pivotally connected at their front ends by pins 106 and 107 to upper leg section side rails 88 and 89, respectively. At their rear ends, seat section side rails 111 and 112 are pivotally connected by pins 113 and 114 to the forward ends of back section side rails 41 and 42, respectively. A seat section plate 119 with holes and grommets 64 and a generally C-shaped cross-section is fixedly secured to side rails 111 and 112 by appropriate means such as welding. Plate 119, in addition to providing a seat surface, also provides additional structural support for seat section 13.

Referring to FIGS. 10 and 12, a drive actuator assembly 120 is connected with seat section 13. Drive actuator assembly 120 includes backing plates 121 and 122, rod 123, handles 124 and 125, C-shaped connection plate 126, and a spring 127. Backing plates 121 and 122 are secured to the outsides of side rails 111 and 112. Rod 123 extends between side rails 111 and 112, through holes in side rails 111 and 112 and plates 121 and 122, and outwardly of plates 121 and 122. Handles 124 and 125 are fixedly secured to the opposing, outwardly extending ends of rod 123, as shown. Connection plate 126 is generally C-shaped and is fixedly secured to rod 123 roughly midway between side rails 111 and 112. Rear and front bumpers 128 and 129 are fixed to the right side of connection plate 126, roughly in line with rod 123, as shown in FIG. 12. Seat plate 119 includes flanges 130 and 131 that extend inwardly toward each other and along the width of plate 119, and spring 127 is stretched between and secured to flanges 130 and 131 to rest just below rod 123 and bumpers 128 and 129, as shown. By pulling or pushing either handle 124 or 125, handles 124 and 125, rod 123 and connection plate 126 all rotate as a unit about the axis of rod 123. Such rotation causes bumpers 128 and 129 to press down against spring 127, and drive actuator assembly 120 is thus biased to stay in the neutral position shown in FIG. 12.

Drive assembly 16 includes any apparatus suitable for providing linear motion to drive links 66 and 67 of drive linkage assembly 65. In the embodiment of FIGS. 1–13, drive assembly 16 includes a worm gear assembly 132 and a gear reduction box 133. Worm gear assembly 132 includes a threaded shaft or "worm" 134 and a follower nut 135 that is driven by the rotation of worm 134 between a rearward position (shown at 136, FIG. 12) and a forward position (shown in phantom at 137). A motor (not shown) is mounted to support plate 138 and, through gear reduction box 133, drives worm 134. Drive links 66 and 67 are connected at their lower ends to follower nut 135 (a first connection end of drive assembly 16) by appropriate means such as thumb screws (one of two screws on opposing sides of worm gear assembly 132 shown at 146 in FIG. 5). Drive assembly 16 is supported at its rearward end (a second connection end of drive assembly 16) by support rods 139 and 140, which are each connected at one end to gear reduction box 133 and at the opposite end to a corresponding drive mounting bracket 29 and 30, respectively. The rotating movement of connection plate 126 controls the operation of drive assembly 16 through connection with a transducer 141 that is supported by a mounting bracket 142 extending down from seat section plate 119. A connection element 144 transmits the motion of connection plate 126 to transducer 141, and the transducer output is relayed to gear reduction box 133 by a suitable cable 143 where it governs the operation of the motor and gear reduction box 133.

In operation from the fully inclined position 7 (FIGS. 8–12), pulling either handle 124 or 125 rotates rod 123 and connection plate 126 which, through transducer 141, actuates drive assembly 16 to rotate worm 134 and move follower nut 135 and the drive links 66 and 67 forwardly. Bed frame sections 12-15 thereby move relative to each other and main frame 11 toward the fully reclined position 5 until either handles 124 and 125 are released or until bed frame 10 reaches the fully reclined position 5. If handles 124 and 125 are released before reaching the fully reclined position 5, spring 127 biases drive actuator assembly 120 back to the neutral position whereupon drive assembly 16 is switched off. Alternatively, should handles 124 or 125 be held in rearwardly rotated positions, whereby worm 134 continues to be forced to rotate, follower nut 135 is constructed such that it will stop moving once a physical limit is reached, either because bed frame sections 12–15 are physically unable to articulate any further, or because a physical element associated with worm gear assembly 132 precludes further translation of follower nut 135 along worm 134. This removes the possibility of damaging the bed frame elements, particularly the drive assembly 16 and motor (not shown). Reversing the handle input (i.e. now pushing the handles 124 and 125 forwardly) actuates drive assembly 16 in the opposite direction, and bed frame 10 is articulated toward the fully inclined position 7. The same limiting elements are provided for limiting movement of follower nut 135 beyond a predefined extreme relating to the fully inclined position 7. Alternative embodiments are contemplated wherein the travel limit of follower nut 135 is defined by an electronic, optical audio or similar sensor of any appropriate type that senses the position of follower nut 135 and electronically and/or mechanically stops the rotation of worm 134 and/or the translation of follower nut 135.

Of particular importance in the configuration and assembly of bed frame 10 is the location of upper crossbar 38 of back section 12 relative to the rear rail 23 of main frame 11. As bed frame 11 is articulated between the fully reclined and fully inclined positions, the rearward end of back section 12 (which is upper crossbar 38) stays substantially vertically aligned with the rear end of main frame 11 (which is rear rail 23). Bed frame 10 thus exhibits a significant wall-hugging feature whereby, during articulation toward the fully inclined position (FIG. 7), the forward end of back section 12 (lower cross bar 40) is drawn rearwardly, while the rearward end (upper crossbar 38) moves very little horizontally. In relative terms, during articulation from the fully reclined to the fully inclined position, the rearward end (38) of back section 12 is desired to move horizontally forward about 25% or less of what the forward end (40) of back section 12 moves horizontally rearward. Consequently, a person lying on bed frame 10 will remain in substantially the same horizontal position relative to a bed table or cabinet that is typically located to one side and at the head of the bed. As used herein, the fully inclined and reclined positions are meant to include this wall-hugging feature whereby the rearward end of back section 12 (here, upper crossbar 38) stays substantially vertically aligned with the rearward end of bed frame 10 (here, rear rail 23), as shown in FIGS. 2–7. In practice, it may be desirable for the rearward end (38) to move at least slightly forwardly during articulation from the fully reclined position so that the rearward end (38) of back section 12 does not contact any structures that may be protruding from a wall behind the bed, such as a picture or medical equipment or connections therefor.

Alternative embodiments are contemplated wherein the lengths and positionments of the various linkages are modified slightly, the result of which is that, during articulation from the fully reclined to the fully inclined position, the rearward end (38) of back section 12 moves horizontally forward slightly greater than 25% of what the forward end (40) of back section 12 moves horizontally rearward. While the configuration of the present invention permits such adjustment, it is preferred that the ratio of forward movement of the rearward end (38) to the rearward movement of forward end (40) be maintained at about 1 to 4 or less than 1 to 4.

With support link assembly 101 mounted at its bottom end for substantially horizontally linear travel in roller channels 35 and 36, and mounted at its top end proximal to pivot axis 20, and thus substantially adjacent to the forward end of seat section 13, the forward end of seat section 13 moves in a substantially horizontal path. Likewise, the bottom end of first drive linkage assembly 65 moves in a substantially horizontally linear path, and the top end is mounted substantially adjacent to the rear end of seat section 13. Consequently, as bed frame 10 is articulated between the fully reclined and fully inclined positions, seat section 13 remains substantially horizontal. Also, as shown in FIGS. 2–7, the greatest overall length of bed frame 10 occurs in the fully reclined position (FIGS. 2 and 3). As bed frame 10 is articulated toward the fully inclined position, the overall length of bed frame 10 is reduced. In addition, the rearmost extend of bed frame 10 is defined by main frame 11, which does not move during articulation. Therefore, if bed frame 10 is positioned against a wall at the rear or head of the bed frame, articulation of the bed frame will not result in contact of back section 12 with the wall unless the entire bed frame is moved.

An easily removable headboard (not shown) and footboard 149 are provided as desired to maintain the position of a mattress (not shown) that is positioned atop articulating bed frame 10. Side rails (not shown) are also provided in a known manner, as appropriate. Vertically adjustable caster sleeves 148 are connected to main frame 11 and are sized and shaped to receive casters (not shown).

Figure 14:
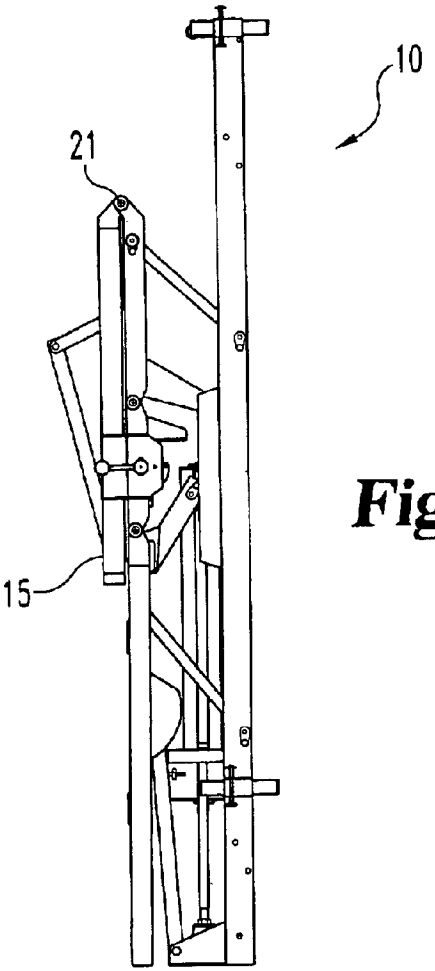
FIG. 14 is a side, elevational of the articulating bed frame 10 of FIG. 13.
Figure 13:
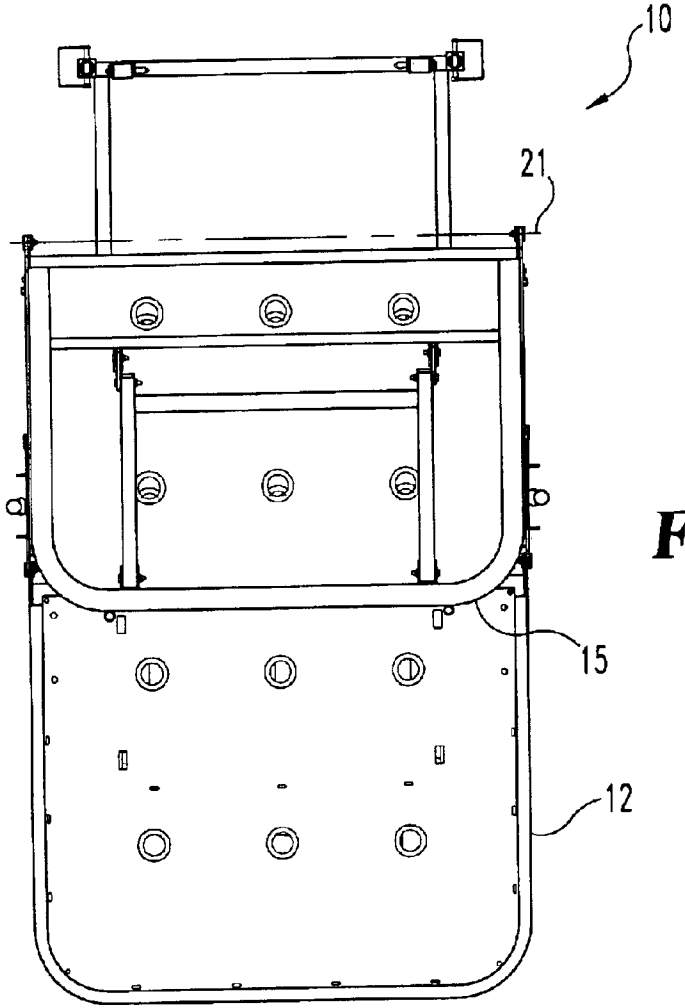
FIG. 13 is a front, elevational view of the articulating bed frame 10 of FIG. 3 and shown in the transport position.

Referring to FIGS. 13 and 14, articulating bed frame 10 can be folded for ease of transport. The transport position is achieved by first removing any headboard or footboard (as necessary), and then by folding lower leg section 15 about 180 degrees from its position in the fully reclined position 5, about axis 21, over and against upper leg section 14 (and seat section 13, depending on the length of lower leg section 15). In the transport position, articulating bed frame 10 is more compact and may be tilted on end, as shown, for movement by hand or with the use of a two-wheel cart or similar device. Alternative embodiments are contemplated wherein lower leg section 15 is folded somewhat less than 180 degrees and to a position not quite against upper leg section 13. While this may be necessary to accommodate some other feature of bed frame 10, such as a particular control apparatus or restraint device, it is preferred that leg frame 15 be able to be folded all the way over and flat against upper leg frame 14 for transport.

Figure 15:
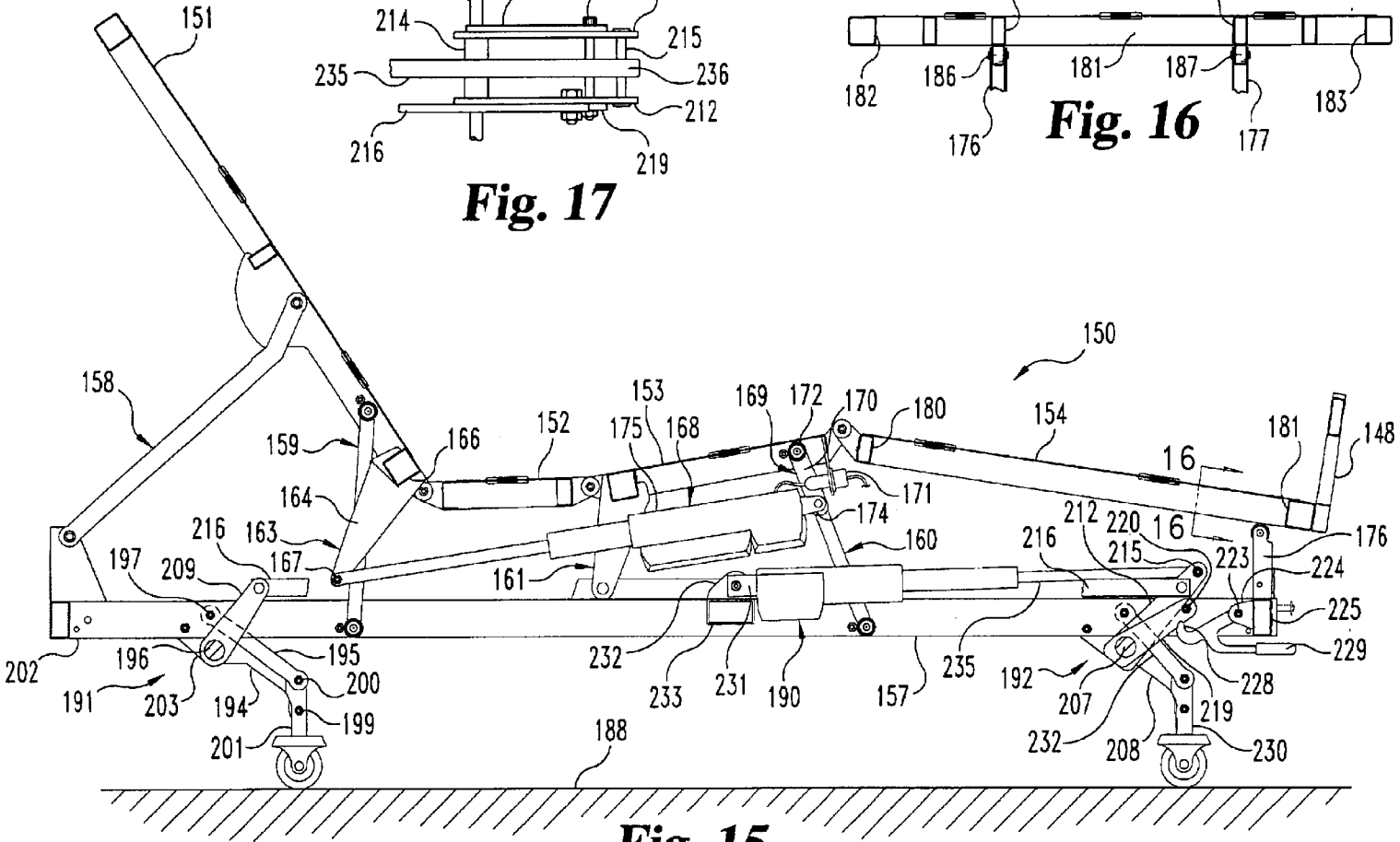
FIG. 15 is side, elevational view of an articulating bed frame 150 in accordance with another embodiment of the present invention.

Referring to FIG. 15 there is shown an articulating bed frame 150 in accordance with an alternative embodiment of the present invention. Like bed frame 10, articulating bed frame 150 includes substantially the same components, such as pivotally interconnected back, seat, upper leg and lower leg sections 151, 152, 153 and 154 that are connected to a main frame 157 by first, second and third linkage assemblies 158, 159 and 160 and support link assembly 161. A first drive linkage assembly 163 includes a pair of drive links (one of two, generally side-by-side links shown at 164) that are each rigidly mounted to lower crossbar 166 of back section 151 and that extends downwardly therefrom for pivotal connection with a first, output end 167 of an articulation drive assembly 168. A second drive linkage assembly 169 includes a pair of drive links (one of two side-by-side links shown at 170) that are each rigidly mounted to upper pivot tube 172 of third linkage assembly 160 and that extends downwardly therefrom for pivotal connection with a second, mounting end 174 of articulation drive assembly 168. Articulation drive assembly 168 is thus essentially pivotally connected to third linkage assembly 160 at point somewhat spaced between upper leg section 153 and main frame 157. Articulation drive assembly 168, like drive assembly 16 of bed frame 10, articulates bed frame 150 between a fully reclined position (like that shown in FIGS. 2 and 3) and a fully inclined position of FIG. 15 (and like that shown in FIGS. 6 and 7), as well as all positions in between. In one embodiment, articulation drive assembly 168 comprises a linear actuator 175 model LA31 from Linak U.S. Inc of Louisville, Ky. Linear actuator 175 has a thrust maximum push of 1349 $lb_f$, a thrust maximum pull of 899 $lb_f$ and a stroke length of up to 11.82 inches. With linear actuator 175 actuated to the extended position, as shown, bed frame 150 is articulated to the fully inclined position. When linear actuator 175 is actuated to the retracted position (not shown), bed frame 150 will be articulated to the fully reclined positioned (like that shown in FIGS. 2 and 3). Actuation of linear actuator 175 is controlled by a user with a suitable keypad or similar device (not shown) electrically connected with linear actuator 175 in a known manner. Power is provided to linear actuator 175 through a standard 110*v* wall socket.

Linear actuator 175 may be any device that is connectable at opposing ends between first and second drive linkage assemblies 163 and 169 and operable to pull and push the distal ends of the drive linkage assemblies 163 and 169 together and apart to articulate bed frame 150 between the fully reclined and fully inclined positions described and shown herein.

Figure 16:
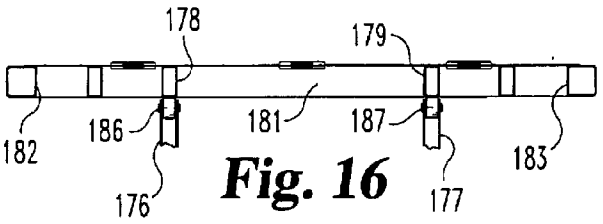
FIG. 16 is a cross-sectional view of the articulating bed frame 150 of FIG. 15 taken along the arrows 16—16, viewed in the direction of the arrows and without footboard 148.

The leg section 154 of bed frame 150 also differs from bed frame 10 in that there are no roller bars 75 and 76 nor hangar links 79 and 80. Instead, front roller mounting brackets 176 and 177 (FIGS. 15 and 16) extend up higher from main frame 157 than roller mounting brackets 31 and 32 of bed frame 10. Also, there is no middle crossbar 71 in the lower leg section, but instead lower leg section 154 includes central rails 178 and 179 that extend between upper and lower crossbars 180 and 181 and are parallel to side rails 182 and 183. Lower leg section 154, and more particularly, central rails 178 and 179, ride upon the raised rollers 186 and 187 of front roller mounting brackets 176 and 177.

Bed frame 150 is also provided with a vertical adjustment apparatus for raising and lowering main frame 157 relative to the ground 188, the apparatus generally including a bed lift drive assembly 190 and four identical castor assemblies, one at each corner of main frame 157 (two shown at 191 and 192). Castor assemblies such as those shown at 191 and 192 are well known and each generally includes a support arm 194 and a control arm 195 pivotally mounted at a proximal end to main frame 157 by separate axles 196 and 197. At their distal ends, each arm 194 and 195 is pivotally mounted at separate pivot points 199 and 200 to a single castor leg 201. This configuration permits castor leg 201 to maintain a constant vertical angle as it rises and falls relative to main frame 157. The pivotal connection of support arm 194 to main frame 157 is achieved by support arm 194 being fixedly connected to axle 196. Axle 196 generally extends between opposing bed frame side rails (one of two opposing and parallel rails shown at 202) and is held for rotation at each such side rail by a bracket (one of two brackets shown at 203) that is fixed to its respective side rail (202). There are thus two such axles—a rear axle 196 and a front axle 207—extending between the opposing side rails of bed frame 157. Rear axle 196 connects the left, rear support arm 194 of bed lift castor assembly 191 with the right, rear support arm (not shown) of the right, rear castor assembly (not shown), the two rear support arms thus rotating as a unit about the axis of axle 196. Likewise, at the front of bed frame 10, the support arms (one of two shown at 208) of front bed lift castor assemblies (one of two shown at 192) are fixedly tied together to rotate as a unit by and with axle 207.

Figure 17:
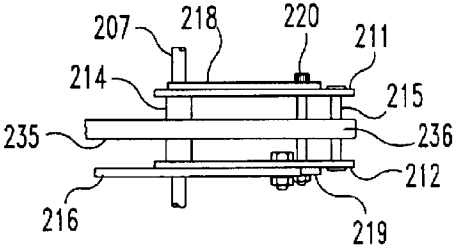
FIG. 17 is a top view of the radial arms 211 and 212 and rocker arms 218 and 219 configuration of the bed frame 150 of FIG. 15.

A radial arm 209 extends rigidly and radially from axle 196, between opposing side rails (one shown at 202). Referring to FIGS. 15 and 17, a pair of radial arms 211 and 212 extend rigidly from a sleeve 214 that is mounted for rotation about front axle 207. A pin 215 is connected to extend between the distal ends of arms 211 and 212. A long connection link 216 is pivotally connected between the distal end of radial arm 209 and arm 212, as shown. A pair of rocker arms 218 and 219 extend rigidly and radially from front axle 207, just outside of radial arms 211 and 212. A limit pin 220 is connected to extend between the distal ends of rocker arms 218 and 219 and on the clockwise side of radial arms 211 and 212, as viewed in FIG. 15. A limit catch 222 is pivotally mounted at pin 223 to a bracket 224, which is fixedly mounted to front rail 225 of main frame 157. Limit catch 222 defines a hook 228 extending generally rearwardly of pin 223 and defines a foot pedal 229 extending generally downwardly and forwardly of pin 223. Limit catch 222 is configured so that depression of foot pedal 229 from the front will pivot limit catch 222 about pin 223, whereby hook 228 will hook up under limit pin 220 and prevent rocker arms 218 and 219 from rotating counterclockwise, as viewed in FIG. 15.

Bed lift drive assembly 190 has a mounting end 231 that is mounted to a bracket 232 that is fixed to a crossbar 233 that extends between the opposing side rails (one shown at 202) of main frame 157. Drive assembly 190 has an output spindle 235 that is operable to extend and retract relative to the mounting end 231, and the distal, output end 236 of spindle 235 is pivotally mounted to pin 215, which is connected to the distal ends of radial arms 211 and 212. In one embodiment, like articulation drive assembly 168, bed lift drive assembly 190 comprises a suitable linear actuator available from Linak U.S. Inc of Louisville, Ky., but may comprise any device capable of extendable and retractable connection between a point on main frame 157 and at least one of radial arms 211 or 212. Actuation of bed lift drive assembly 190 is controlled by a user with a suitable keypad or similar device (not shown) electrically connected with bed lift drive assembly 190 in a known manner.

The operation of the vertical adjustment apparatus of bed frame 150 will now be described. Reference to clockwise and counterclockwise rotations and other movement and positional movements relative to bed frame 150 are as viewed in FIG. 15. In operation and with limit catch in a deactivated position (as shown in FIG. 15), retraction actuation of bed lift drive assembly 190 pulls radial arms 212 and 209 to rotate counterclockwise. Consequently, support arm 194 and control arm 195 rotate about their mounting points at 196 and 197, respectively, and castor leg 201 rises relative to main frame 157. Also, at the front of bed frame 150, radial arms 211 and 212 are caused to rotate counterclockwise. With the axis of front axle 207 being offset from the front castor legs (one of two shown at 230), the weight of bed frame 157 biases axle 207 to rotate counterclockwise, such rotation only limited by limit pin 220 bearing on the clockwise underside of radial arms 211 and 212. As radial arms 211 and 212 rotate counterclockwise about the axis of axle 207, so do rocker arms 218 and 219, and the front castor legs also rise relative to main frame 157, and the front of main frame 157 drops. If limit catch 222 is actuated by depressing foot pedal 229 to cause hook 228 toward engagement with limit pin 220, when radial arms 211 and 212 rotate counterclockwise, rocker arms 218 and 219 rotate with them until hook 228 engages limit pin 220. Then rocker arms 218 and 219 are prevented from rotating counterclockwise any further. Radial arms 211 and 212 can continue to rotate (via drive assembly 190) and, consequently, only the rear portion of bed frame 157 is lowered.

Extension actuation of bed lift drive assembly 190 rotates all of radial arms 209, 211 and 212 clockwise. If limit catch 222 was not engaged, both the front and rear portions of main frame 157 will rise equally. If limit catch 222 was engaged, the front will begin to raise as soon as radial arms 211 and 212 rotate clockwise to engage limit pin 220 at which point rocker arms will be rotated clockwise, as well, which will move limit pin out of engagement with hook 228. Limit catch 222 is configured and mounted to bracket 224 to be biased toward a rest position, disengaged from limit pin 220 (as shown in FIG. 15) until it is depressed and held by foot pedal 229.

While the invention has been illustrated and described in detail in the drawings and foregoing description, the same is to be considered as illustrated and not restrictive in character, it being understood that only the preferred embodiment has been shown and described and that all changes and modifications that come within the spirit of the invention are desired to be protected.

What is claimed is:

1. A bed frame, comprising:

a main frame;

a back section;

a seat section pivotally connected to said back section;

an upper leg section pivotally connected to said seat section;

a lower leg section pivotally connected to said upper leg section;

a first linkage assembly pivotally connected at an upper end to said back section and pivotally connected at an opposite lower end to said main frame;

a second linkage assembly pivotally connected at an upper end to said back section and pivotally connected at an opposite lower end to said main frame;

a third linkage assembly pivotally connected at an upper end to said upper leg section and pivotally connected at an opposite lower end to said main frame;

a support link assembly connecting said upper leg section for sliding and pivoting movement relative to said main frame;

first means for movably supporting said lower leg section atop said main frame; and, a drive assembly connected between said back section and one of said main frame and said third linkage assembly for articulating said bed frame between a fully reclined position and a fully inclined position.

2. The bed frame of claim 1 wherein said drive assembly is connected at a first end with said back section and at a second end to said main frame.

3. The bed frame of claim 2 wherein said drive assembly comprises a worm gear assembly mounted at the second end to said main frame and having a follower nut connected at the first end with said back section, the worm gear assembly being operable to move the first end toward and away from the second end to articulate said bed frame.

4. The bed frame of claim 1 wherein said drive assembly is connected at a first end with said back section and is connected at a second end to said third linkage assembly.

5. The bed frame of claim 4 wherein said drive assembly is a linear actuator operable to selectively retract and extend its first and second ends toward and away from each other to articulate said bed frame.

6. The bed frame of claim 5 wherein said drive assembly includes a first drive linkage assembly rigidly connected at a first end to said back section and extending generally downwardly therefrom to an opposing distal second end that is pivotally connected with the first end of said linear actuator.

7. The bed frame of claim 5 wherein said drive assembly includes a second drive linkage assembly that is pivotally connected at a first end to said third linkage assembly and is pivotally connected at an opposing distal second end to the second end of said linear actuator.

8. The bed frame of claim 1 wherein said main frame includes at least one roller channel, and said support link assembly includes at least one support link rigidly connected at a first end to said upper leg section and extending generally downwardly therefrom to an opposing distal second end that is sized and configured to engage with and follow in the roller channel.

9. The bed frame of claim 8 wherein the at least one roller channel is generally C-shaped and the at least one support link includes a roller rotatably mounted at the distal second end, the roller being sized and configured to ride within the at least one C-shaped roller channel.

10. The bed frame of claim 8 wherein said main frame includes first and second opposing side rails and said at least one roller channel includes first and second roller channels mounted to the first and second side rails.

11. The bed frame of claim 1 wherein said first means is a track and guide assembly connected with said lower leg section and said main frame to permit said lower leg section to ride freely along the forward end of main frame.

12. The bed frame of claim 11 wherein the track and guide assembly includes at least one roller rotatably mounted to a forward end of said main frame and at least one roller bar mounted to said lower leg frame to ride atop the at least one roller.

13. The bed frame of claim 1 further including a transport position wherein said lower leg section is folded about 180 degrees and from the fully reclined position, and rests substantially flat against said upper leg frame.

14. An articulating bed frame, comprising:

a main frame;

a back section, an upper leg section, a seat section pivotally connected at opposing ends to said back section and said upper leg section, and a lower leg section pivotally connected to said upper leg section;

a first linkage assembly being pivotally connected at opposing first and second ends to said back section and said main frame;

a second linkage assembly being pivotally connected at opposing third and fourth ends to said back section and said main frame;

a third linkage assembly being pivotally connected at opposing fifth and sixth ends to said upper leg section and said main frame, respectively;

a support link assembly connecting said upper leg section for sliding and pivotal movement with said main frame;

first means for movably supporting said lower leg frame atop said main frame; and, a drive assembly connected between said back section and one of said main frame and said third linkage assembly, said drive assembly being operable to extend and retract to articulate said bed frame between a fully reclined position and a fully inclined position.

15. The bed frame of claim 14 wherein said drive assembly is connected at a first connection end to said back section and at a second connection end to said main frame.

16. The bed frame of claim 15 wherein said drive assembly comprises a worm gear assembly mounted at the second connection end to said main frame and having a follower nut connected at the first connection end with said back section, the worm gear assembly being operable to move the nut and first connection end toward and away from the second connection end to articulate said bed frame.

17. The bed frame of claim 14 wherein said drive assembly is connected at a first end with said back section and at a second, opposing end with said third linkage assembly.

18. The bed frame of claim 14 wherein said drive assembly comprises a linear actuator operable to selectively retract and extend its first and second ends toward and away from each other.

19. The bed frame of claim 18 wherein said drive assembly includes a first drive linkage assembly that is rigidly connected at a first end to said back section and extends generally downwardly therefrom to an opposing distal second end that is pivotally connected with the first end of said linear actuator.

20. The bed frame of claim 18 wherein said drive assembly includes a second drive linkage assembly that is pivotally connected at a first end to said third linkage assembly and is pivotally connected at an opposing distal second end to the second end of said linear actuator.

21. The bed frame of claim 14 wherein said main frame includes at least one roller channel and said support link assembly includes at least one support link that is rigidly connected at a first end to said upper leg section and that extends generally downwardly therefrom to an opposing distal second end that is sized and configured to engage with and follow in the roller channel.

22. The bed frame of claim 21 wherein the at least one roller channel is generally C-shaped and the at least one support link includes a roller rotatably mounted at the distal second end, the roller being sized and configured to ride within the at least one C-shaped roller channel.

23. The bed frame of claim 21 wherein said main frame includes first and second opposing side rails and said at least one roller channel includes first and second roller channels mounted to the first and second side rails.

24. The bed frame of claim 14 wherein said first means is a track and guide assembly connected with said lower leg section and said main frame to permit said lower leg section to ride freely along the forward end of main frame.

25. The bed frame of claim 24 wherein the track and guide assembly includes at least one roller rotatably mounted to a forward end of said main frame and at least one roller bar mounted to said lower leg frame to ride atop the at least one roller.

26. The bed frame of claim 14 further including a transport position wherein said lower leg section is folded about 180 degrees and from the fully reclined position, and substantially rests flat against said upper leg frame.

27. The bed frame of claim 1 further including a transport position wherein said lower leg section is folded about 180 degrees from the fully reclined position, and rests substantially flat against said upper leg frame.

28. An articulating bed frame, comprising:

a main frame;

a back section;

first and second linkage assemblies, each being pivotally connected at spaced apart first and third ends to said back section and pivotally connected at opposing, spaced apart and respective second and fourth ends to said main frame;

an upper leg section;

a third linkage assembly pivotally connected at opposing fifth and sixth ends to said upper leg section and said main frame;

a support link assembly connecting said upper leg section for sliding and pivotal movement with said main frame;

a seat section pivotally connected at opposing ends to said back section and said upper leg section;

a lower leg section pivotally connected to said upper leg section and freely supported atop a forward end of said main frame; and, a drive assembly connected between said back section and said third linkage assembly and operable to extend and retract to articulate said bed frame between a fully reclined position and a fully inclined position.

29. A method for articulating a bed frame between fully reclined and fully inclined positions, comprising the steps of:

providing a bed frame including:

a main frame, a back section connected to the main frame by first and second linkage assemblies, each of the first and second linkage assemblies being pivotally connected at first and third ends to said back section and pivotally connected at opposing respective second and fourth ends to said main frame, an upper leg section connected to the main frame by a third linkage assembly and a support link assembly, the third linkage assembly being pivotally connected at opposing fifth and sixth ends to the upper leg section and the main frame, respectively, and the support link assembly being rigidly connected at a seventh end to the upper leg section and being slidably and pivotably connected at an opposing eighth end to said main frame, a seat section pivotally connected at opposing ends to the back section and said upper leg section, a lower leg section pivotally connected to said upper leg section and freely supported atop a forward end of said main frame, and a drive assembly connected at first and second connection ends to and between the back section and one of the main frame and the third linkage assembly, the drive assembly being operable to extend and retract to move the first and second connection ends away and toward each other; and, from the fully reclined position, actuating the drive assembly to move the first and second connection ends away from each other to articulate the bed frame toward the fully inclined position, and from the fully inclined position, actuating the drive assembly to move the first and second connection ends toward each other to articulate the bed frame toward the fully reclined position.

30. The method for articulating a bed frame of claim 29 wherein the step of providing a bed frame includes the drive assembly being connected at its first connection end to the back section and at its second connection end to the third linkage assembly.

31. The method for articulating a bed frame of claim 30 wherein the step of providing a bed frame includes the drive assembly being pivotally connected at its second connection end to the third linkage assembly.

32. The method for articulating a bed frame of claim 31 wherein the step of providing a bed frame includes the drive assembly including a first drive linkage assembly that is rigidly connected at a first end to said back section and extends generally downwardly therefrom to an opposing distal second end that is pivotally connected with the first connection end of said linear actuator.

33. The method for articulating a bed frame of claim 31 wherein the step of providing a bed frame includes the drive assembly including a second drive linkage assembly that is pivotally connected at a first end to said third linkage assembly and is pivotally connected at an opposing distal second end to the second connection end of said linear actuator.

34. An articulating bed frame, comprising:

a single main frame having a front end and a rear end;

a back section having a forward end and a rearward end;

first and second linkage assemblies, each being pivotally connected at first and third ends to said back section and pivotally connected at opposing and respective second and fourth ends to said main frame;

an upper leg section;

a third linkage assembly pivotally connected at opposing fifth and sixth ends to said upper leg section and said main frame, respectively;

a support link assembly connecting said upper leg section for sliding and pivotal movement with said main frame;

a seat section pivotally connected to said back section and said upper leg section;

a lower leg section pivotally connected to said upper leg section and supported at one portion atop said main frame; and, a drive assembly connected between said back section and said third linkage assembly and operable to extend and retract to articulate said bed frame between a fully reclined position and a fully inclined position.

35. The articulating bed frame of claim 34 wherein, during articulation between the fully reclined position and the fully inclined position, the rearward end of said back section moves horizontally about 25% or less of what the forward end of said back section moves horizontally.

36. The articulating bed frame of claim 34 wherein, during articulation between the fully reclined position and the fully inclined position, the rearward end of said back section remains substantially vertically aligned with the rear end of said main frame.

* * * * *